US005617756A

United States Patent [19]

Thudium et al.

[11] Patent Number: 5,617,756

[45] Date of Patent: Apr. 8, 1997

[54] TRANSFER DEVICE IN A METAL-FORMING MACHINE

[75] Inventors: Karl Thudium, Waeschenbeuren; Peter Klemm, Stuttgart; Hans Hofele, Goeppingen, all of Germany

[73] Assignee: Schuler Pressen GmbH & Co., Goeppingen, Germany

[21] Appl. No.: 443,410

[22] Filed: May 17, 1995

[51] Int. Cl.[6] ..... B21D 43/05

[52] U.S. Cl. ..... 72/405.16; 72/405.13

[58] Field of Search ..... 72/405.11–405.16, 72/405.01, 421

[56] References Cited

U.S. PATENT DOCUMENTS

| | | | |
|---|---|---|---|
| 4,024,749 | 5/1977 | Taniguchi et al. . | |
| 4,653,311 | 3/1987 | Tack | 72/405.11 |
| 4,873,860 | 10/1989 | Werner | 72/405.01 |
| 5,001,921 | 3/1991 | Schneider et al. . | |
| 5,218,855 | 6/1993 | Werner | 72/421 |
| 5,488,852 | 2/1996 | Nishikawa | 72/405.13 |

FOREIGN PATENT DOCUMENTS

| | | |
|---|---|---|
| 1452769 | 3/1972 | Germany . |
| 3213381A1 | 10/1983 | Germany . |

*Primary Examiner*—Daniel C. Crane
*Attorney, Agent, or Firm*—Evenson, McKeown, Edwards & Lenahan, P.L.L.C.

[57] ABSTRACT

In the case of transfer presses and similar metal-forming machines, transfer devices must be provided for the transport of the sheet metal parts through the metal-forming stages. The lifting and lowering movement should be freely programmable, yet, a drive for the lifting and lowering movement is to be permitted which is free from play. This is achieved by the use of servo motors or similar motors with a hollow-shaft rotor and high-resolution position generators for the direct application on the transfer device, in which case the hollow-shaft rotor of each of the servo motors is provided with a spindle nut which, interacts with a spindle which is fastened on the transfer device in a non-rotatable manner.

4 Claims, 2 Drawing Sheets

TRANSFER DEVICE IN A METAL-FORMING MACHINE

Figure 1:
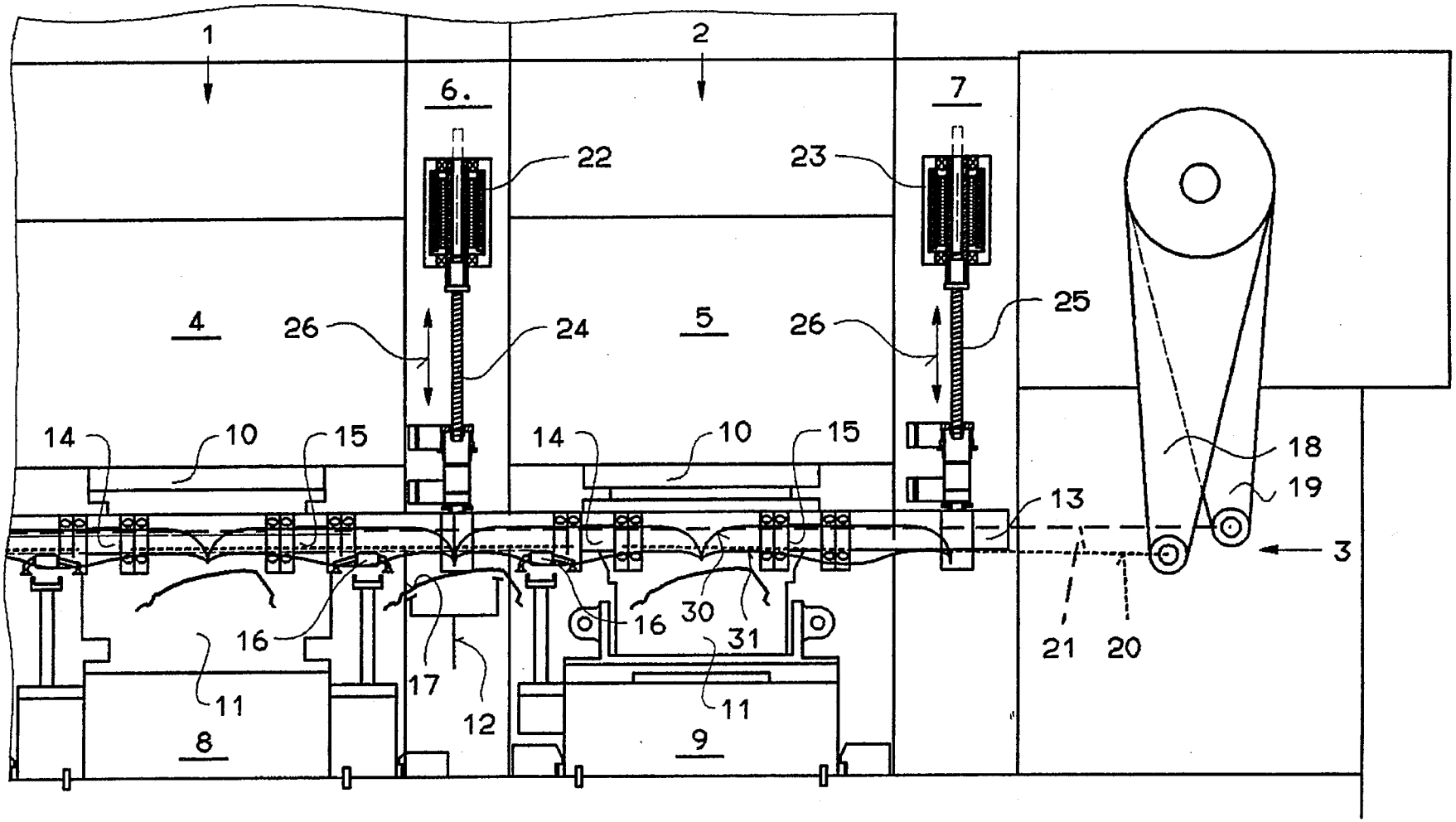

This invention relates to a transfer press or similar metal-forming machine comprising a transfer device according to the preamble of claim 1.

In metal-forming machines of the above-mentioned type, transfer devices are required in order to transfer sheet metal parts from one machine stage to the next, optionally with an intermediate depositing. The invention can be applied to various known transfer systems, for example, to those comprising gripper rails which extend through the metal-forming machine and its longitudinal course and have active and passive gripping tools as holding devices for gripping the sheet metal parts. Another transfer system consists of running rails which extend in the longitudinal course of the metal-forming machine and on which suction bars as holding devices are disposed in a displaceable manner or on which suction bars are fastened so that they can be coupled. The different transfer systems have a lifting and lowering movement in common for lifting the sheet metal parts out of the respective tool bottom part or for depositing the sheet metal parts in the machining stage which follows.

German Patent Document DE 26 32 593 A1 describes a three-dimensional advancing device (transfer device) for a transfer press with two gripper rails constructed with gripping tools as holding devices. For generating the transfer movements, a plurality of transmission and deflecting drives and bearings are required, and between the introduction of the movement and the tapping of the movement, tolerances add up to form an excessively high tolerance chain so that, on the whole, vibrations cannot be avoided in the system. As a result, the gripping and depositing of the sheet metal parts in not precise.

From German Patent Document DE 32 13 381 A1, an arrangement is known for supporting the gripper rails in a transfer press. By means of this arrangement, a sagging and vibration movements of the gripper rails are to be prevented. In this case, one cross traverse respectively is arranged between two lifting and closing cases which are form-lockingly connected by way of a toothed rack—pinion connection with the gripper rails drives. The abovementioned disadvantages also exist here, and the overall mass to be moved is significantly increased.

From German Published Patent Application 14 52 769, an arrangement is known for conveying workpieces to be machined in a press and having driving devices for displacing and lifting gripper rails. The driving devices are assigned directly to the movements, in which case the driving device for the lifting and lowering acts from below by way of a console carrying the driving devices and movement deflecting devices for the transverse movement, and therefore does not act directly on the gripper rail. The driving devices are piston-cylinder units which are acted upon by fluid and which permit a precise placing only by way of stops or do not permit a change of the basic height. In addition to the abovementioned disadvantages, the inertia of the masses and the control and response times of the drives also have disadvantageous effects on the number of strokes.

Another transfer system is indicated in European Patent Document EP 0 384 188 A2 and has running rails which extend through the press and on which carriages are disposed which carry out the transfer movements. The lifting and lowering movements of the running rails and therefore of the carriages and of the holding devices for the sheet metal parts disposed on these takes place by a tapping of the movement on one cam per running rail by means of cam follower levers and a transmission linkage which, in transmission cases on several press stands, deflects the movement into the vertical direction. The introduction of the lifting-lowering movement into the running rails takes place at several points of application which are distributed along the overall length of the running rails. This system also has the disadvantages of long transmission trains, such as the number of used devices and therefore tolerance chains, vibrations and the like.

It is an object of the invention to provide a drive for the lifting—lowering movement which is free from play and has a high stiffness because of the use of only one transfer element.

This object is achieved by means of the characteristics of the characterizing part of claim 1. On the one hand, the lifting-lowering movement can be freely programmed in an advantageous manner while all motors run synchronously. On the other hand, by avoiding large masses and long transmission chains and therefore vibrations, a precise positioning is possible in the lifting movement and lifting height to be set. In a particularly advantageous manner, by using such servo motors, the disadvantageous effect of the change of play can be overcome which so far has been achieved in drive chains only at high expenditures, for example, by means of pressure cylinders.

By means of an embodiment illustrated in the drawing, the invention will be explained in detail in the following.

Figure 2:
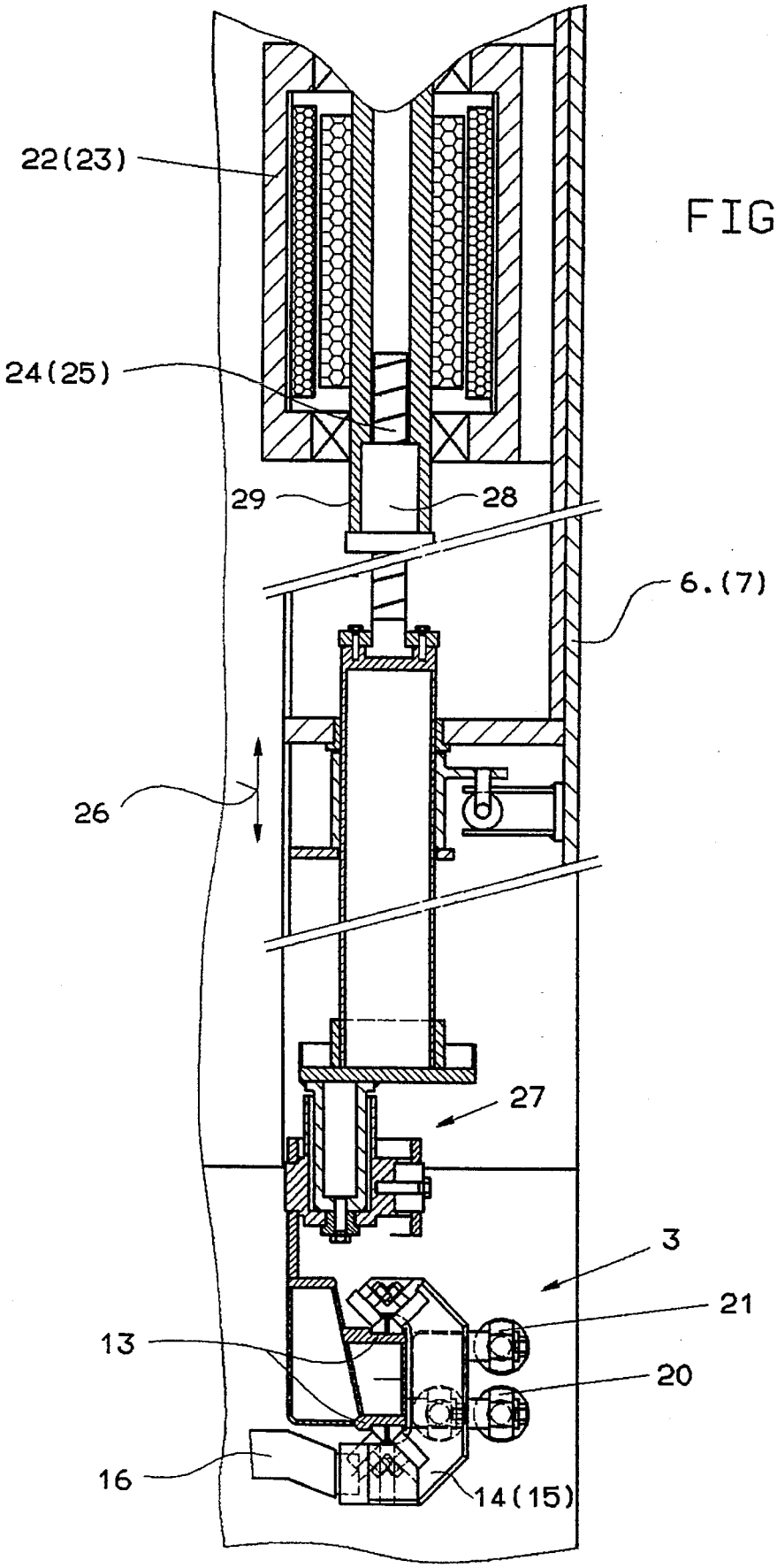

FIG. 1 is a view of a portion of a transfer press with the devices according to the invention; and FIG. 2 is a view of a press stand area with the devices of the invention.

The illustrated metal-forming machine, here a transfer press, comprises machining stages 1, 2 with slides 4, 5, which move up and down, and with tool top parts 10 which are fastened on these slides 4, 5, and with tool bottom parts 11 which are placed on sliding tables 8, 9. The construction of the transfer press includes press stands 6, 7 in whose areas intermediate depositing devices 12 may be arranged.

Reference number 3 indicates a transfer device as a whole comprising one running rail 13 extending in front of the machining stages and one running rail 13 extending behind the machining stages respectively in the longitudinal course of the transfer press. On the running rails, carriages 14, 15 can be moved by way of linkages 20, 21 in a slidable manner and in moving cams 30, 31. In this case, carriages which are situated on the running rails in pairs opposite one another are connected by means of one or several suction bars 16. These form the holding devices for the sheet metal parts.

The transfer movements of the carriages in the cams 30, 31 have horizontal movement components which are generated by the cam taps by means of cam follower levers 18, 19, and vertical movement components which are generated by the lifting and lowering of the running rails. The lifting and lowering in the direction of the double arrow 26 is caused by servo motors 22, 23 which, as illustrated, are arranged above the transport plane of the sheet metal parts 17, on the whole, above the height of the forward-motion cam 30. The invention also provides the possibility of arranging the servo motors 22, 23 below the transport plane. Likewise, the transfer device may be one which comprises gripper rails and gripping tools, in the case of which the lifting and lowering movement may be caused in the same manner, that is, moving in two or three axes, by means of servo motors.

The press cut-out in the area of one of the stands 6, 7 illustrated in FIG. 2 shows the suspending of a running rail 13. Carriages 14, 15 can be slid on the running rail. For the horizontal movement,—the horizontal section of the moving cams 30, 31 in FIG. 1—driving linkages are fastened to the carriages. Each of the servo motors 22, 23 has a hollow shaft—a so-called hollow-shaft rotor 29—on which a spindle nut 28 is fixed. The spindle nut, which may be a prestressed spindle nut, interacts with a spindle 24, 25 which is rigidly connected directly to the running rail or, as illustrated, by way of an eccentric construction, is rigidly connected indirectly to the running rail. The eccentric construction is used for an adjusting movement of the running rails to the outside and back, as described in detail in European Patent Document EP 0 384 188 A2. A spindle motor kit with a hollow-shaft rotor of the firm Mannesmann Rexroth, Indramat GmbH, which is equipped with a high-resolution generator, may be used as the servo motor.

We claim:

1. A machine in the form of a transfer press, large-piece transfer press, press facility and metal-forming machine for forming sheet metal parts, comprising a transfer device arranged to be movable in synchronization with the machine and having holding devices for gripping and transporting the sheet metal parts through the machine, and a lifting and lowering drive arranged to act, on a press-side, upon the transfer device, comprising servo motors with a vertically disposed hollow-shaft rotor extending therefrom and a high-resolution position signal generator for direct association with the transfer device, the hollow-shaft rotor of each of the servo motors being provided with a spindle nut interacting with a spindle non-rotatably fastened on the transfer device for substantially vertical lifting and lowering movements.

2. The machine according to claim 1, wherein the servo motors are mounted above a transport plane for the sheet petal parts on the press side and are applied vertically from thereabove.

3. The machine according to claim 1, wherein the servo motors are mounted below transport plane for the sheet metal parts on the press side and are applied vertically from therebelow.

4. The machine according to claim 1, wherein the hollow-shaft rotor of the servo motor is rigidly connected with the spindle nut which is prestressed and projects in a collar-like manner partially beyond an end edge of the hollow-shaft rotor.

* * * * *